US006405910B1

(12) United States Patent
Infanti et al.

(10) Patent No.: US 6,405,910 B1
(45) Date of Patent: Jun. 18, 2002

(54) REMOVABLE RETAINING CLIP ASSEMBLY

(75) Inventors: James C. Infanti; Jason Griffin, both of Waterloo (CA)

(73) Assignee: Research In Motion Limited, Waterloo (CA)

( * ) Notice: Subject to any disclaimer, the term of this patent is extended or adjusted under 35 U.S.C. 154(b) by 0 days.

(21) Appl. No.: 09/799,649

(22) Filed: Mar. 6, 2001

Related U.S. Application Data

(60) Provisional application No. 60/246,179, filed on Nov. 6, 2000.

(51) Int. Cl.[7] ..... A45C 11/00

(52) U.S. Cl. ..... 224/668; 24/3.7; 224/269; 224/271; 224/669; 224/930

(58) Field of Search ..... 224/668, 269, 224/912, 930, 669, 271, 272; 24/3.7, 3.8, 3.9; 361/814; 455/100

(56) References Cited

U.S. PATENT DOCUMENTS 4,083,481 A * 4/1978 Selinko ..... 224/269
4,299,344 A * 11/1981 Yamashita et al. ..... 224/242
4,881,150 A * 11/1989 Oyamada ..... 24/3.11
5,081,709 A * 1/1992 Benyo et al. ..... 224/669
5,241,592 A * 8/1993 Carlson et al. ..... 361/814
5,261,122 A * 11/1993 Otsuki et al. ..... 224/670
5,261,583 A * 11/1993 Long et al. ..... 206/305
5,297,318 A * 3/1994 Adolphson et al. ..... 224/148.4
5,375,749 A * 12/1994 Oliva ..... 224/242
5,385,282 A * 1/1995 Chen ..... 224/269
5,475,752 A * 12/1995 Mischenko ..... 379/433.08
5,620,120 A * 4/1997 Tien ..... 224/194
5,661,798 A * 8/1997 Chen ..... 379/446
5,829,102 A * 11/1998 Conti ..... 24/3.1
5,988,577 A * 11/1999 Phillips et al. ..... 224/197
6,029,871 A * 2/2000 Park ..... 224/197
6,082,600 A * 7/2000 Angus et al. ..... 224/236
6,141,417 A * 10/2000 Lopez et al. ..... 379/446
6,161,741 A * 12/2000 French ..... 224/192
6,282,802 B1 * 9/2001 Iden ..... 33/347
6,286,736 B1 * 9/2001 Angus et al. ..... 224/236
6,298,857 B1 * 10/2001 Schmidt ..... 131/250
6,311,881 B1 * 11/2001 Kamiya ..... 224/195

* cited by examiner

*Primary Examiner*—Stephen P. Garbe
(74) *Attorney, Agent, or Firm*—Jones, Day, Reavis & Pogue; Charles B. Meyer; Krishna K. Pathiyal

(57) ABSTRACT

An apparatus is provided for use with a handheld device. The apparatus includes a panel configured to provide support for the handheld device, defining an aperture and having a mating structure located in the aperture. The apparatus further includes a clip assembly operative to engage an article of clothing and configured to releasably attach to the mating structure, and thereby to impart a first configuration to the apparatus. The apparatus also includes a replacement insert configured to releaseably attach to the mating structure in place of the clip assembly, and thereby to impart a second configuration to the apparatus.

15 Claims, 7 Drawing Sheets

REMOVABLE RETAINING CLIP ASSEMBLY

PRIORITY

This application claims priority on U.S. Provisional Application Serial No. 60/246,179, filed on Nov. 6, 2000.

FIELD OF THE INVENTION

This invention relates to the field of carrying cases, particularly those of the type used to carry small, portable electronic devices.

BACKGROUND

A standard carrying case-or pouch generally includes an integral clip. Such a clip is used to attach the case to such things as a belt or over the waistline of clothes. Mobile handhelds, such as the RIM® 950 Wireless Handheld™, are carried in cases having such a clip. The clip is used to attach the case to the user's belt or over the waistline of their clothes, as examples, to make carrying easier.

Carrying cases with integral clips do not allow the user to remove the clip in order to carry the device more easily in pockets. That is, the clip can make the case bulky. Cases made bulky by clips can be problematic if the pouch or case is to be placed in a small, enclosed area such as a pocket. It may sometimes be desirable to decrease the bulk of a carrying case by removing the clip from the carrying case.

SUMMARY OF THE INVENTION

The present invention provides an apparatus for use with a handheld device. The apparatus includes a panel configured to provide support for the handheld device, defining an aperture and having a mating structure located in the aperture. The apparatus further includes a clip assembly operative to engage an article of clothing and configured to releasably attach to the mating structure, and thereby to impart a first configuration to the apparatus. The apparatus also includes a replacement insert configured to releaseably attach to the mating structure in place of the clip assembly, and thereby to impart a second configuration to the apparatus.

The present invention also provides an apparatus for use with a handheld communication device. The apparatus includes a panel defining an aperture and operative to support the device. The apparatus further includes a clip assembly including a first mating structure configured to attach to the panel, and thereby to impart a first configuration to the apparatus. The apparatus also includes a replacement insert including a second mating structure configured to releasably attach to the panel and replace the clip assembly, and thereby to impart a second configuration to the apparatus.

The present invention provides a method for use with a handheld device of attaching a clip assembly to a panel. The method includes providing a clip assembly having a recess, and the recess having a tab. The method further includes providing a panel defining an aperture, and having a tongue located in the aperture and having a slot configured to mate with the tab. The method also includes directing the clip assembly into the aperture so that the tongue mates with the recess and the tab mates with the slot, thereby to attach the clip assembly to the panel.

The present invention further provides a method for use with a handheld device for detaching a clip assembly from a panel having an aperture. The method includes providing a clip assembly having a recess and a panel having a tongue located in the aperture, the tongue having a slot and the recess having a tab, the clip assembly being mated to the aperture, the tongue being mated with the recess and the tab being mated with the slot, thereby to secure the clip assembly to the panel. The method further includes directing the tongue away from recess, thereby to disengage the slot from the tab. The method also includes directing the clip assembly out of the aperture, thereby to detach the clip assembly from the panel.

The present invention provides a method for use with a handheld device for attaching a replacement insert to a panel having an aperture. The method includes providing the replacement insert having a recess and a panel having a tongue located in the aperture, the tongue having a slot and the recess having a tab. The method further includes directing the replacement insert into the aperture so that the tongue mates with the recess and the tab mates with the slot, thereby attach the replacement insert to the panel.

The present invention further provides a method for use with a handheld device for detaching a replacement insert from a panel having an aperture. The method includes providing a replacement insert having a recess, and a panel having a tongue located in the aperture, the tongue having a slot and the recess having a tab, the replacement insert being mated to the aperture, the tongue being mated with the recess and the tab being mated with the slot, thereby to secure the clip assembly to the panel. The method also includes directing the tongue away from recess, thereby to disengage the slot from the tab. The method further includes directing the replacement insert out of the aperture, thereby to detach the replacement insert from the panel.

The clip assembly of the present invention is particularly useful for cases and pouches that hold, store, and carry handheld electronic devices. Examples of such devices include data and communication devices.

DESCRIPTION OF PREFERRED EMBODIMENTS

Figure 2:
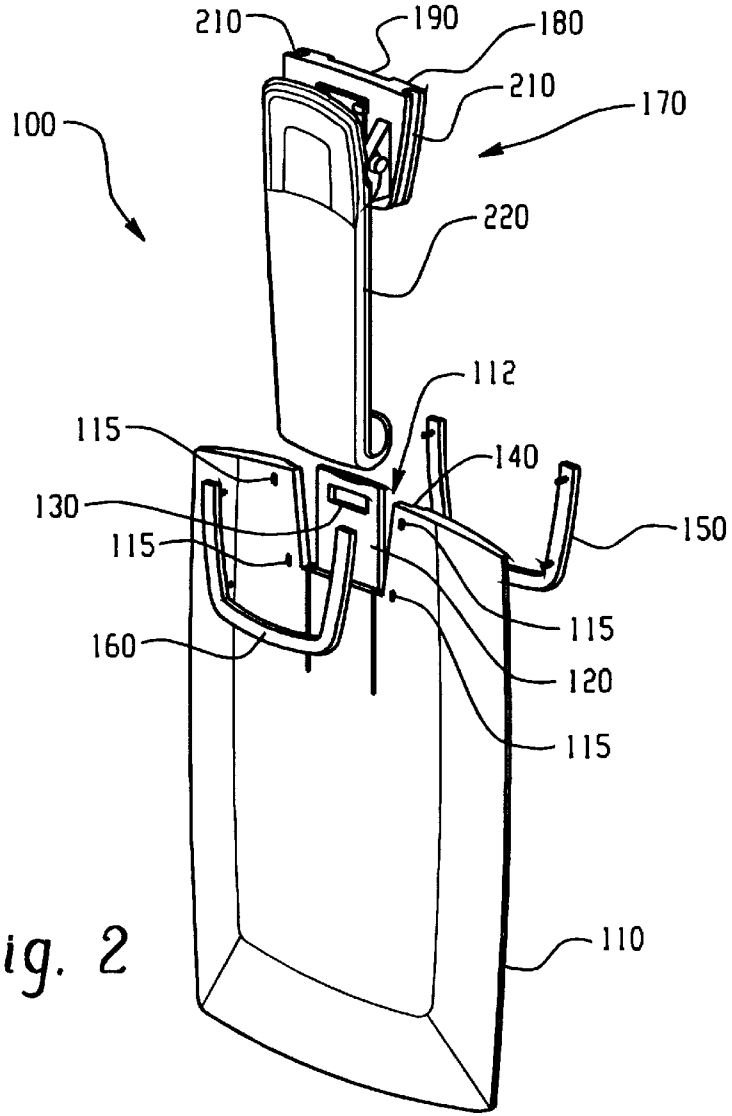
FIG. 2 is an exploded, orthogonal back view of the apparatus shown in FIG. 1 in a first configuration.
Figure 1:
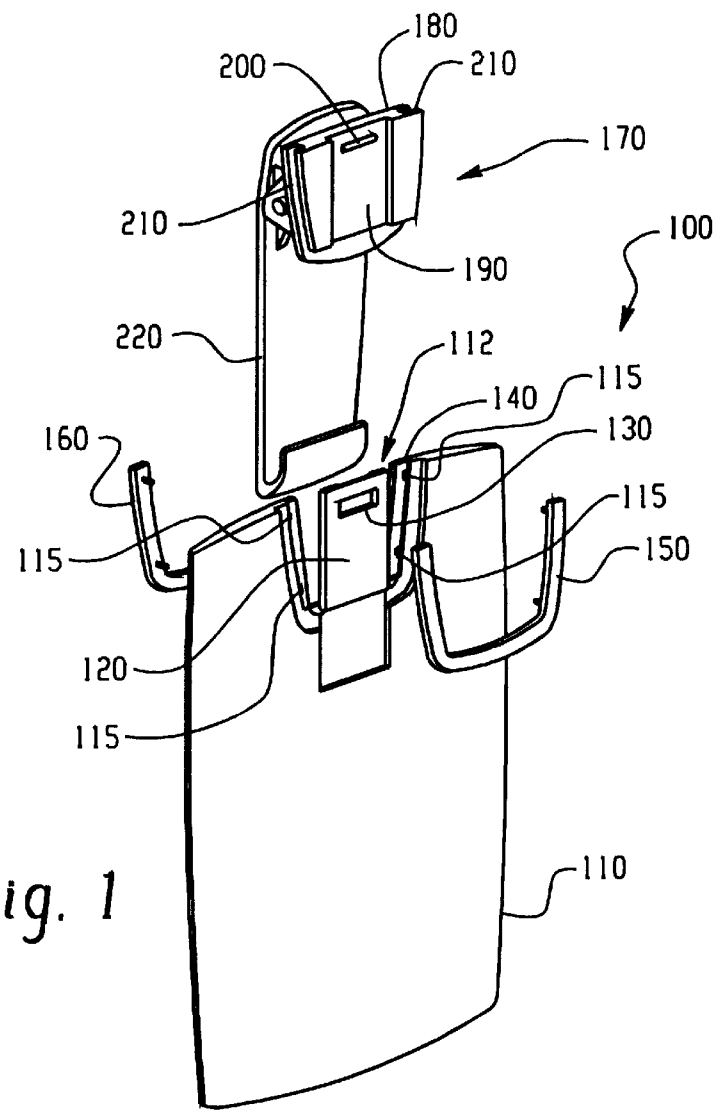
FIG. 1 is an exploded, orthogonal front view of an apparatus comprising a first embodiment of the invention in a first configuration.
Figure 4:
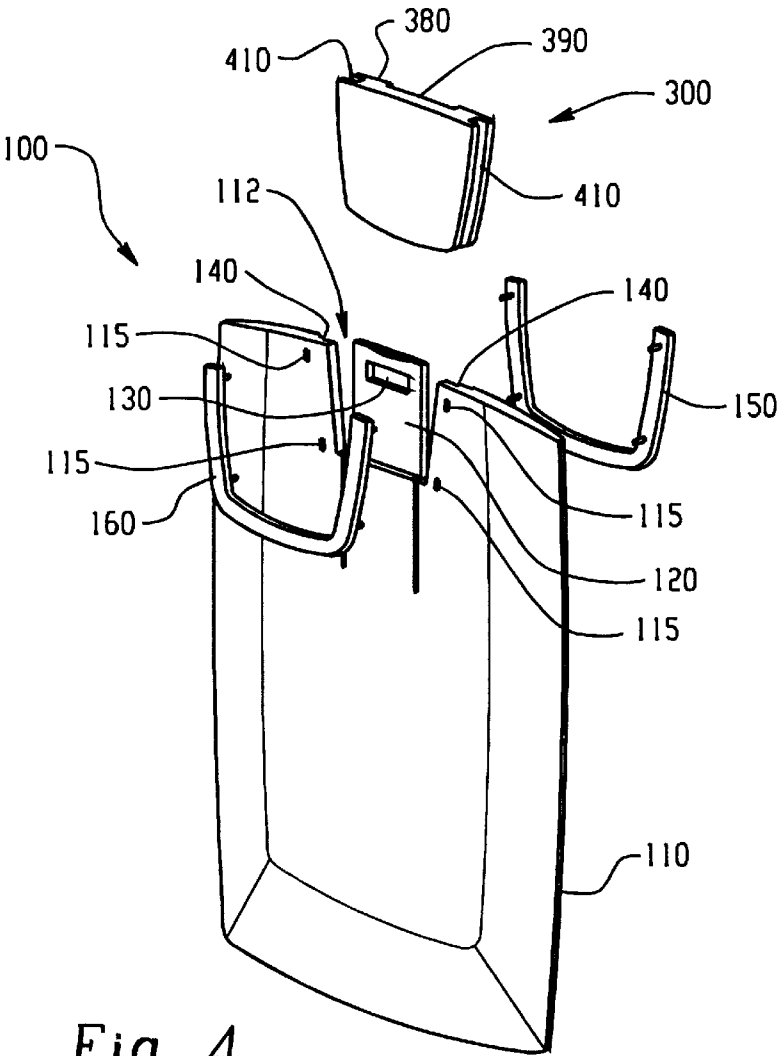
FIG. 4 is an exploded, orthogonal view of the apparatus shown in FIG. 1 shown in a second configuration.
Figure 3:
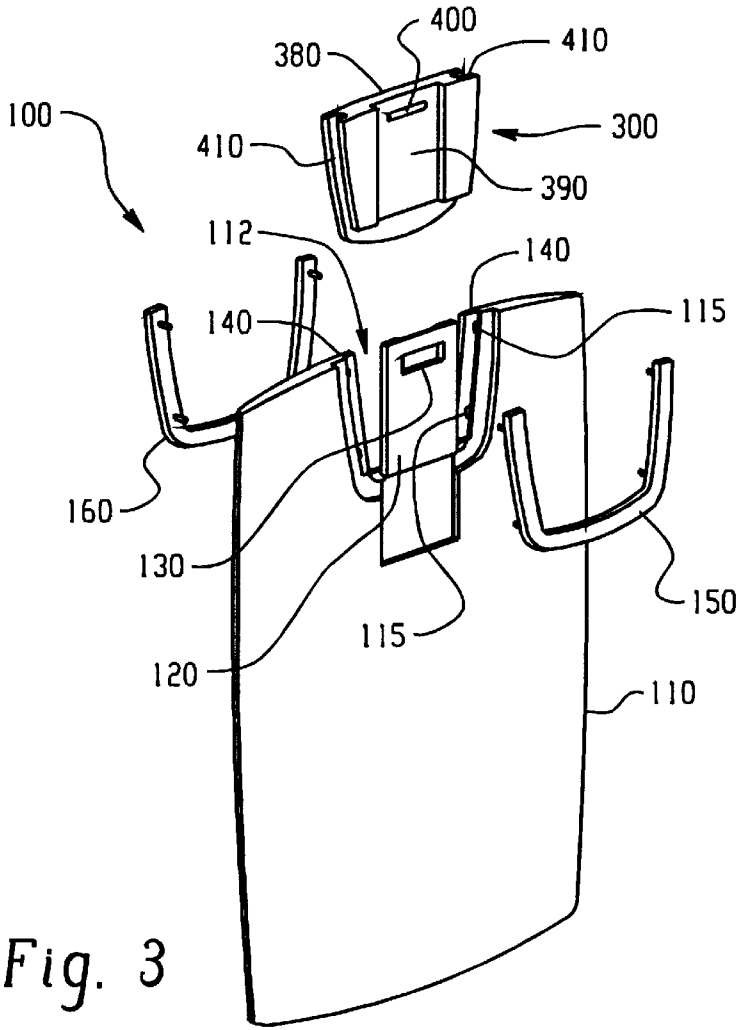
FIG. 3 is an exploded,,orthogonal view of the apparatus shown in FIG. 1 in a second configuration.

An apparatus 100 comprising a first embodiment of the invention in a first configuration is shown in an exploded, orthogonal front view in FIG. 1 and rear view in FIG. 2. The apparatus 100 is shown in a second configuration in an exploded, orthogonal front view in FIG. 3 and rear view in FIG. 4. The apparatus 100 is a carrier case stiffener with interchangeable inserts. In the first configuration, the apparatus 100 can clip to a belt or over the waistline of clothes. In the second configuration, the apparatus 100 is less bulky so as to fit in a pocket.

The apparatus 100 includes a panel 110 made of plastic and has a top, a bottom, a front, and a back. The panel 110 has an aperture 112, i.e., a cutout section at the top, center of the panel 110. Crimp holes 115 are arranged in an array around the cutout section. The panel fits into the back of a pouch, not shown. The pouch is a carrier case for a mobile handheld electronic device, such as the RIM® 957 Wireless Handheld™. In this embodiment, the pouch is made of fabric, such as leather.

A tongue 120, having a rectangular slot 130 is located in the cutout section at the top, center of the panel 110. The tongue 120 is flush with the top of the panel 110. The tongue 120 is a resilient plastic mating structure. A protruding ridge 140 lines the inner edge of the cutout section at the top, center of the panel 110. A front crimp 150 and a back crimp 160 are located on the front and back of the panel 110, respectively. The front 150 and back 160 crimps attach to the panel 110 by means of the crimp holes 115 in the panel 110. The fabric of the pouch, not shown, is positioned between both the front 150 and back 160 crimp and the panel 110. Alternative embodiments can have the fabric positioned only in front of and only in back of the panel 110.

Figure 10:
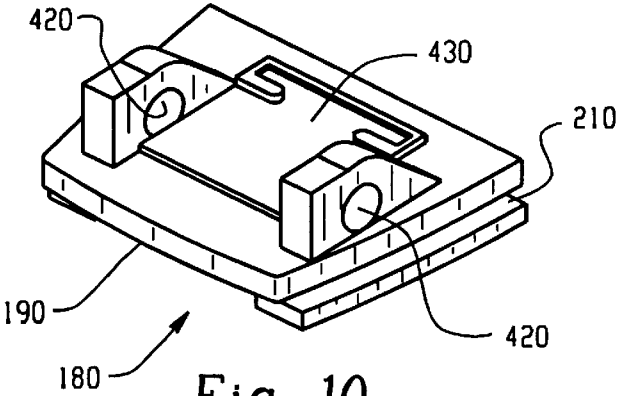
FIG. 10 is an enlarged orthogonal back view the part of the apparatus shown in FIG. 9.
Figure 9:
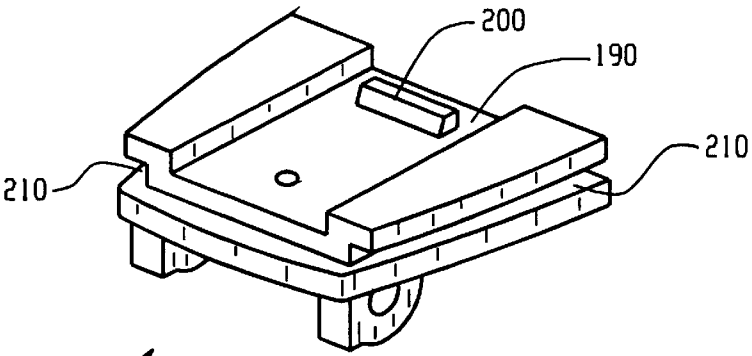
FIG. 9 is an enlarged orthogonal front view of part of the apparatus shown in FIG. 1.

In the first configuration of this embodiment, the apparatus 100 includes a clip assembly 170 mated to the panel 110. The clip assembly 170 includes a base 180. An orthogonal front view of just the base 180 is shown in FIG. 9 and an orthogonal back view is shown in FIG. 10. The base 180 has a front, a back, a top, two sides, and a bottom. Returning to FIGS. 1 through 4, the front of the base 180 has a channel shaped recess 190, i.e., a wide shallow depression. The size and shape of the recess 190 are such that it can mate with the tongue 120. The recess 190 is defined by the surfaces of the base 180 and extends fully from end to end of the base 180. A tab 200 is located in the recess 190. The size, shape, and position of the tab 200 are such that it can mate with the slot 130 when the tongue 120 is fully engaged with the recess 190. The two sides of the base 180 each have a recessed groove 210 that extends from the bottom to the top of the base 180.

The clip assembly 170 also includes a clip 220 that is spring loaded and attached to the back of the base 180. The manner of attachment and assembly of the clip 220 to the back of the base 180 is described in patent application Ser. No. 09/305174 Retaining Clip Assembly filed May 4, 1999, now U.S. Pat. No. 6,073,318.

Figure 12:
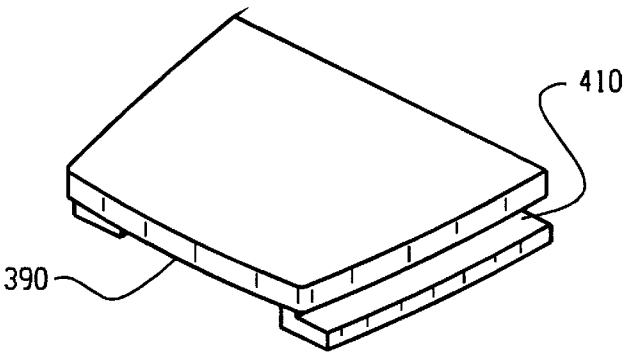
FIG. 12 is an enlarged orthogonal back view the part of the apparatus shown in FIG. 11.
Figure 11:
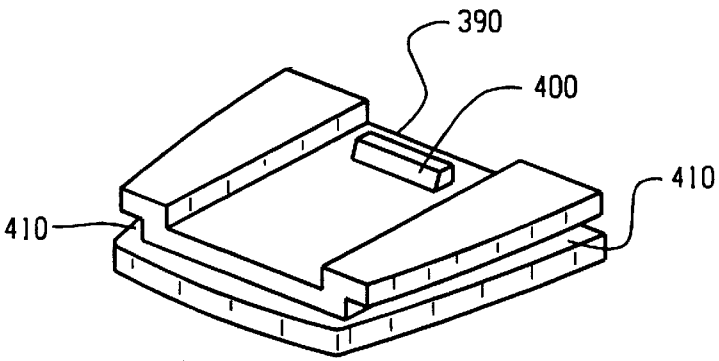
FIG. 11 is an enlarged orthogonal front view of part of the apparatus shown in FIG. 4.
Figure 14:
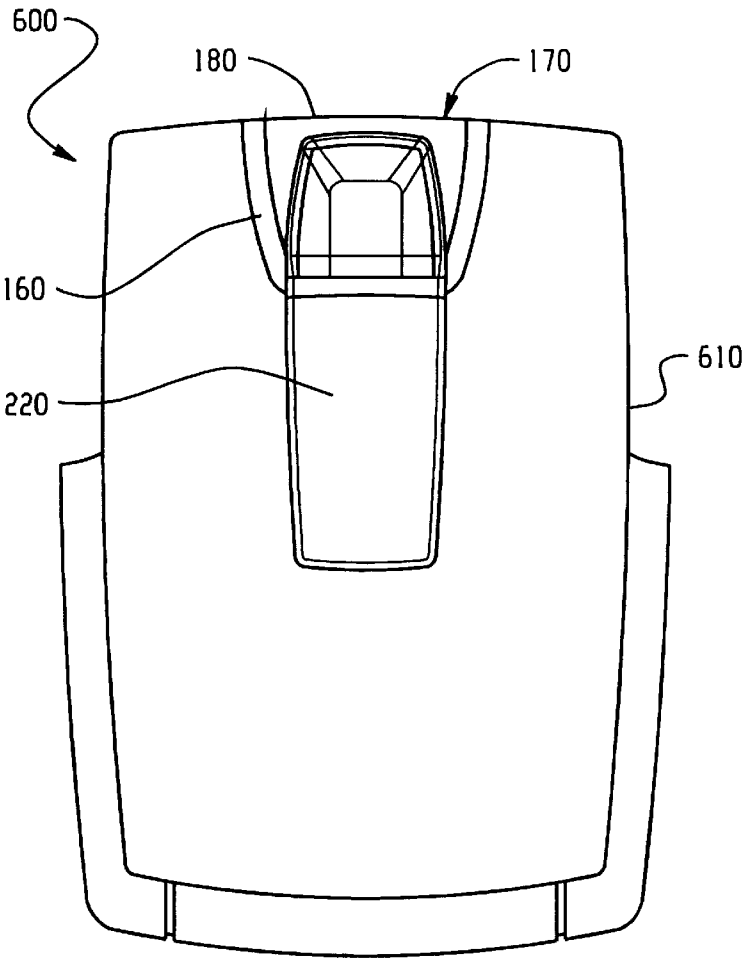
FIG. 14 is a schematic back view of the apparatus shown in FIG. 13 in a first configuration.

In the second configuration of this embodiment, a replacement insert 300 is mated with the tongue 120 in the cutout section of the panel 110. The replacement insert 300 has parts that are substantially similar to parts of the clip assembly 170. The replacement insert 300 includes a base 380. A front orthogonal view of the base 380 is shown in FIG. 11 and a back orthogonal view is shown in FIG. 12. The base 380 has a front, a back, a top, two sides, and a bottom. Returning to the FIGS. 1 through 4, the front of the base 380 has a recess 390, i.e., a narrow depression. The size and shape of the recess 390 are such that it can mate with the tongue 120. A tab 400 is located in the recess 390. The size and shape of the tab 400 are such that it can mate with the slot 130. The two sides of the base 380 each have a recessed groove 410 that extends from the bottom to the top of the base 380.

When the apparatus 100 is secured in the pouch, the front 150 and back 160 crimps secure the panel 110 to the fabric of the pouch using the crimp holes 165. The pouch fabric has an opening and covers the apparatus 100 except for the opening. The panel 110 is covered in the fabric except for the front 150 and back 160 crimps. Part of either clip assembly 170 or the replacement assembly 300 may be visible through the opening depending on whether the apparatus 100 is in the first or second configuration. The panel 110 stiffens the pouch and allows it to maintain its proper form.

Figure 6:
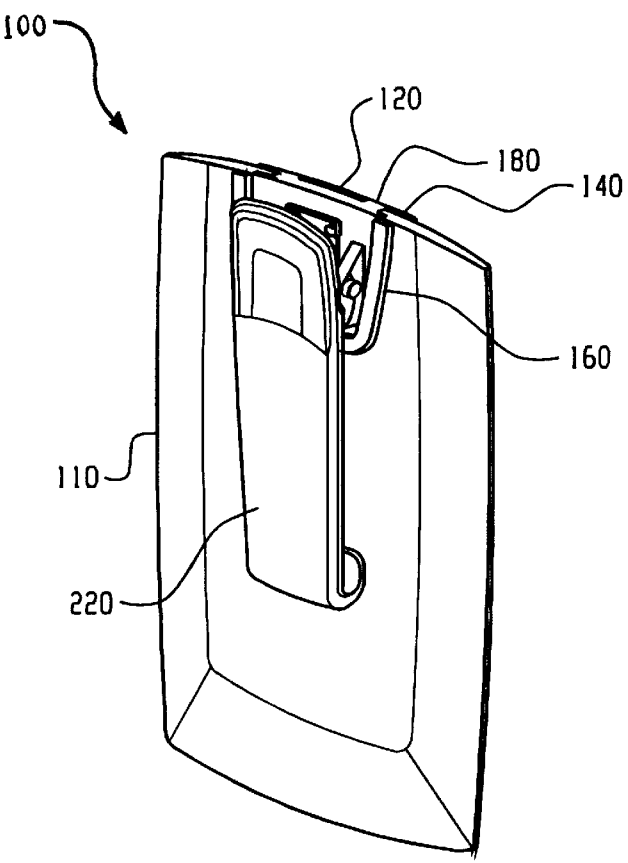
FIG. 6 is an orthogonal back view of the assembled apparatus shown in FIG. 5.
Figure 5:
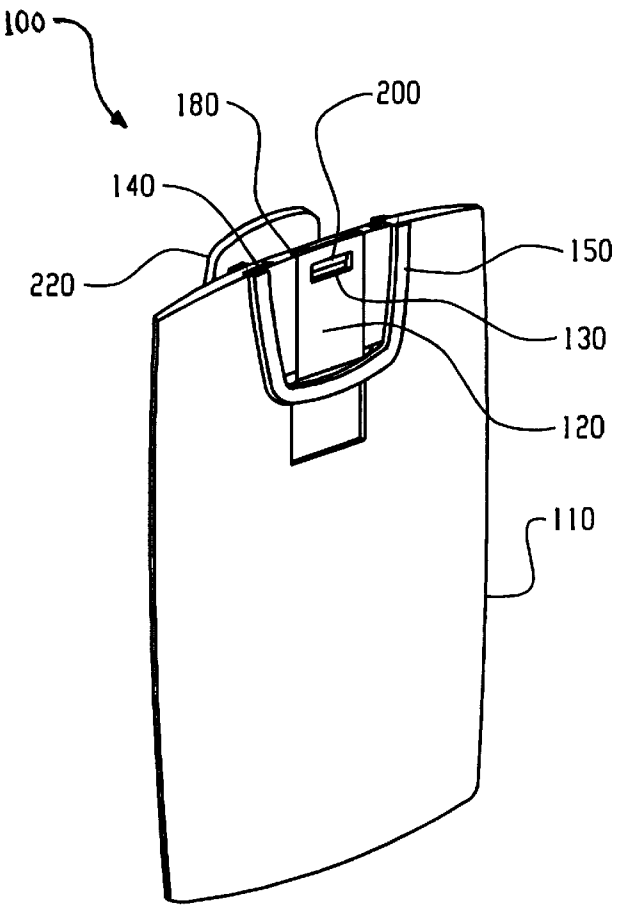
FIG. 5 is an orthogonal front view of the apparatus shown in FIG. 1 assembled and in a first configuration.

In the first configuration, shown in FIGS. 5 and 6, the clip assembly 170 is mated with the cutout section of the panel 110. Specifically, the base 180 slides into the cutout section of the panel 110 oriented so that the fronts of both the base 180 and the panel 110 are facing the same direction. The recess 190 slides over the tongue 120 and each groove 210 on the side of the base 180 slides over the respective ridge 140. The base 180 is removably secured in place when the slot 130 slides over the tab 200 on the tongue 120.

While in the first configuration the front of the panel is oriented with the pouch so that it faces toward the pouch front. The clip 220 extends through the opening in the fabric of the pouch so that it extends downward, outside of the pouch. In this manner, the clip assembly 170 is securely attached to the panel 110 and can clip the pouch and its contents to various items. As examples, the pouch can be clipped to a belt and a sun visor.

The bulk of the clip 220 may increase the total size of the carrying case. It may sometimes be desirable to reduce the size of the carrying case. For example, the first configuration may not fit into small bounded areas such as pockets as well as a carrying case having a smaller total size, i.e., less bulk.

The clip assembly 170 can be removed from the cutout section of the panel 110 by applying pressure to the tongue 120, pulling it toward the front of the pouch, such that the slot 130 is moved from around the tab 200. This allows the base 180 to slide out of the cutout section of the panel 110. This allows the apparatus 100 to switch from the first configuration to the second configuration.

Figure 8:
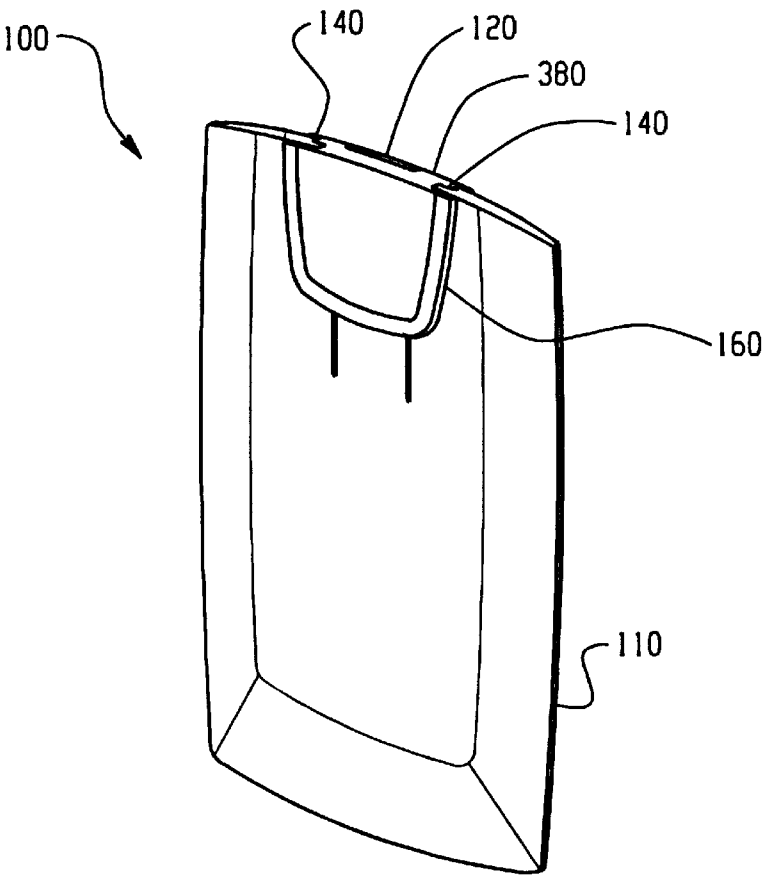
FIG. 8 is an orthogonal back view of the assembled apparatus shown in FIG. 7.
Figure 7:
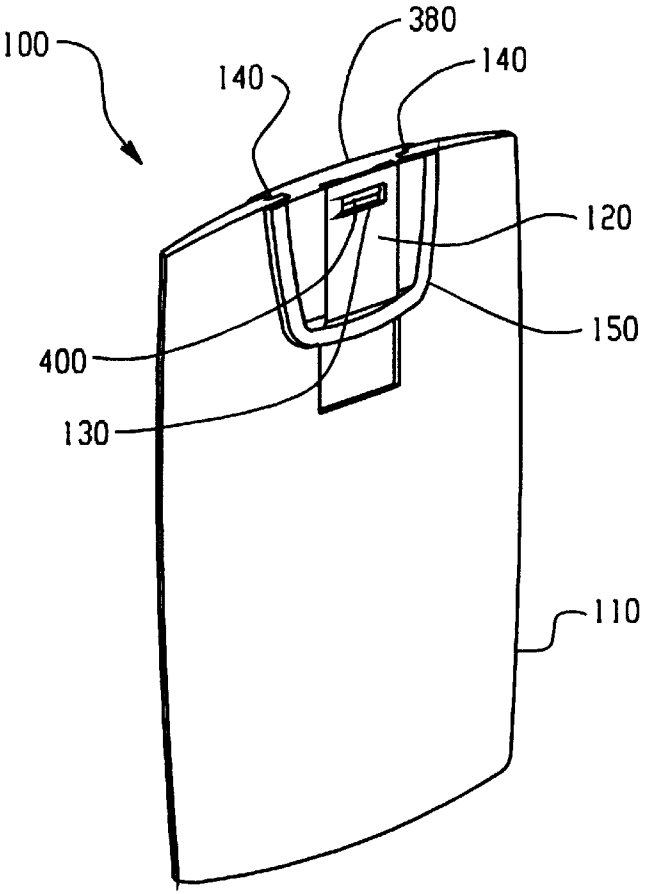
FIG. 7 is an orthogonal front view of the apparatus shown in FIG. 1 assembled and in a second configuration.

In the second configuration, shown in FIGS. 7 and 8, the replacement insert 300 is mated with the panel 110 in the cutout section rather than the clip assembly 170 being mated with the panel 110. Specifically, the base 380 is directed into the cutout section of the panel 110 oriented so that the fronts of both the base 380 and the panel 110 are facing the same direction. The recess 390 slides over the tongue 120 and each groove 410 slides over the respective ridge 140. The base 380 is removably secured in place when the slot 130 slides over the tab 400 on the tongue 120. The replacement insert 300 is flush with the lip of the cutout in the panel 110.

The replacement insert 300 can be removed from the cutout section of the panel 110 by applying pressure to the tongue 120, pulling it toward the front of the pouch, such that the slot 130 is moved from around the tab 400. This allows the base 380 to slide out of the cutout section of the panel 110. This allows the apparatus 100 to switch from the second configuration to the first configuration.

FIG. 9 shows a front orthogonal view of the base 180 of the clip assembly 170. FIG. 10 shows the back of the base 180 of the clip assembly 170. This view shows receptacles 420 for the clip 220. There is also an indentation 430 to accommodate a C-shaped leaf spring, not shown. FIG. 11 shows a front orthogonal view of the base 380 of the replacement insert 300. FIG. 12 shows the back view, respective of FIG. 11.

Figure 13:
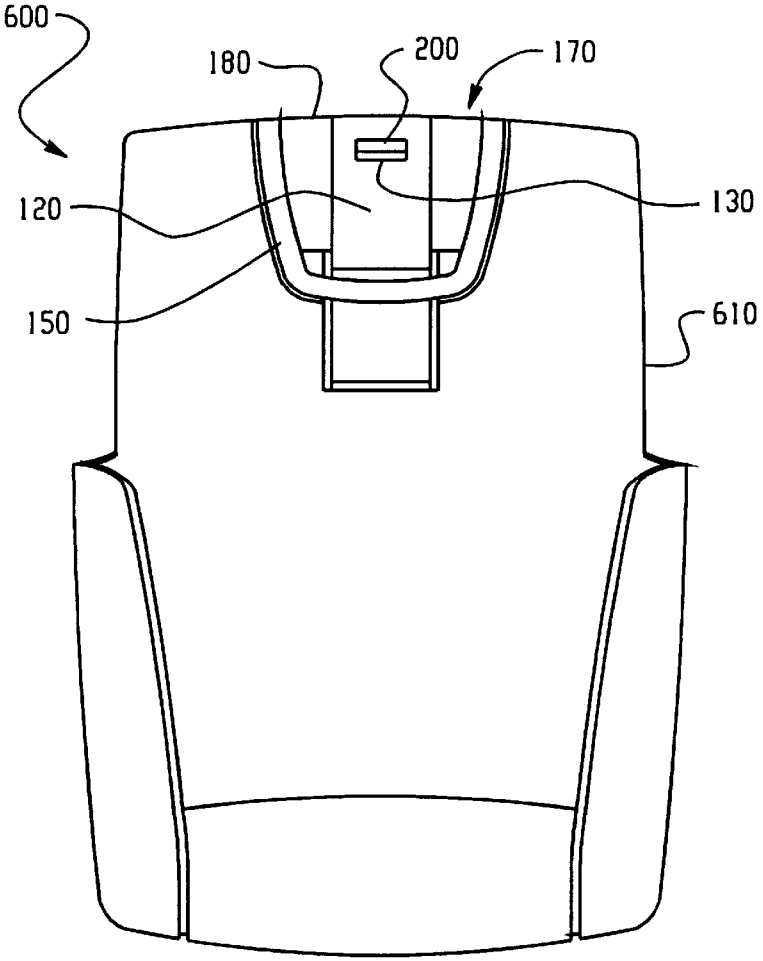
FIG. 13 is a schematic front view of an apparatus comprising a second embodiment of the invention in a first configuration.
Figure 16:
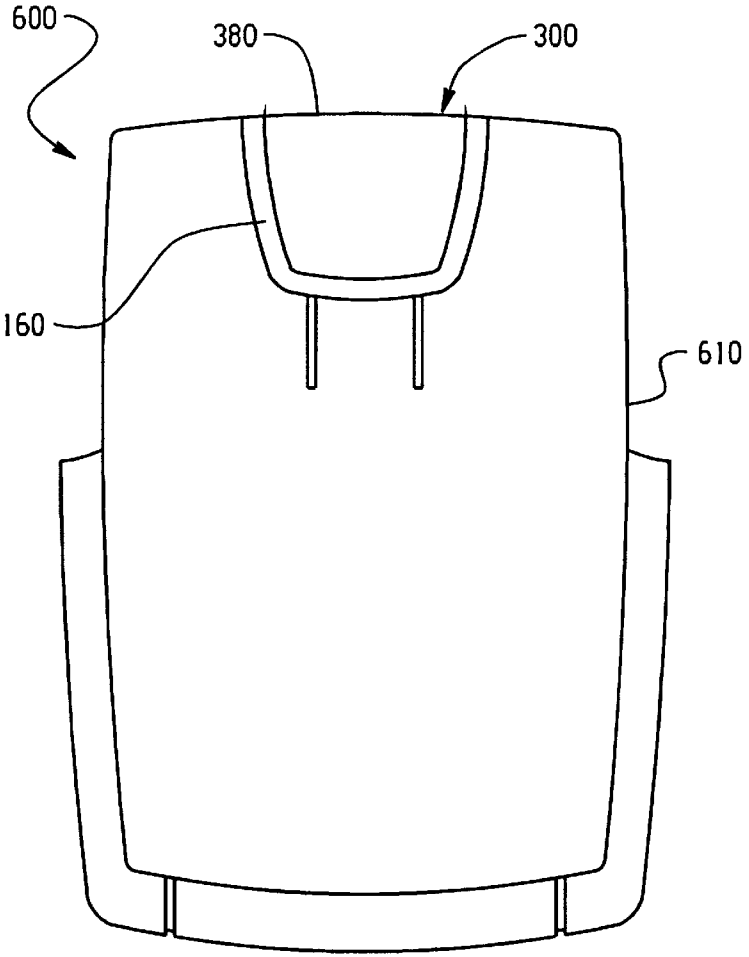
FIG. 16 is a schematic back view of the apparatus shown in FIG. 15.
Figure 15:
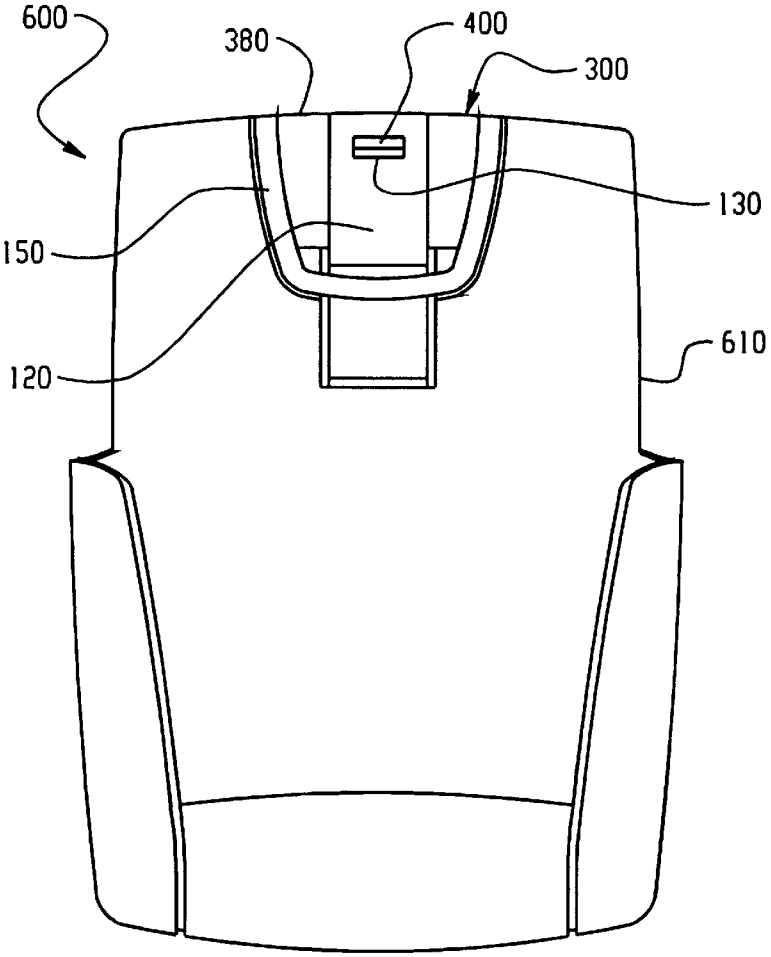
FIG. 15 is a schematic front view of the apparatus shown in FIG. 13 in a second configuration.

An apparatus 600 comprising a second embodiment of the invention is shown in FIG. 13. The apparatus 600 has many parts that are substantially the same as corresponding parts of the apparatus 100. This is indicated by the use of the same reference numbers for such corresponding parts in FIGS. 1–4 and FIGS. 13–16. However, the second embodiment of the invention differs from the first embodiment in that a holster 610 replaces the pouch of the first embodiment.

The holster 610 sides and bottom extend toward the front to form a repository for a mobile handheld device. Specifically, the holster 610 is generally open and includes curved side portions and a bottom formed to conform to the shape of the mobile handheld device.

Similar to the apparatus 100, the apparatus 600 includes two configurations. In the first configuration, the apparatus 600 includes the clip assembly 170. The clip assembly 170 is slid into the cutout section at the top of the holster 610. The clip assembly 170 is oriented such that both it and the holster 610 face in the same direction while the clip assembly 170 is secured in the cutout section.

The clip assembly 170 can be removed from the cutout section of the holster 610 by applying pressure to the tongue 120, pulling it toward the front of the pouch, such that the slot 130 is moved from around the tab 200. This allows the base 180 to slide out of the cutout section of the holster 610. This allows the apparatus 600 to switch from the first configuration to the second configuration.

In the second configuration, the apparatus 600 includes the replacement insert 300. The replacement insert 300 mated with the holster 610 in the cutout section rather than the clip assembly 170. Specifically, the base 380 slides into the cutout section of the holster 610 and is oriented so that the fronts of both the base 380 and the holster 610 are facing the same direction. The recess 390 slides over the tongue 120 and each groove 410 slides over the respective ridge 140. The base 380 is removably secured in place when the slot 130 slides over the tab 400 on the tongue 120. The replacement insert 300 is flush with the lip of the cutout in the holster 610.

The replacement insert 300 can be removed from the cutout section of the holster 610 by applying pressure to the tongue 120, pulling it toward the front of the pouch, such that the slot 130 is moved from around the tab 400. This allows the base 380 to slide out of the cutout section of the holster 610. This allows the apparatus 600 to switch from the second configuration to the first configuration.

In other embodiments of the present invention, examples of the handheld device include cellular phones, digital wireless phones, 1-way pagers, 1½-way pagers, 2-way pagers, electronic mail appliances, internet appliances, personal digital assistants (PDA), laptop computers, and portable digital audio players.

It will be appreciated that the above description relates to the preferred embodiments by way of example only. Many variations on the invention will be obvious to those knowledgeable in the field, and such variations are within the scope of the invention as described and claimed.

What is claimed is:

1. A method for use with a handheld device of attaching a clip assembly to a panel comprising:

a) providing a clip assembly having a recess, and the recess having a tab;

b) providing a panel defining an aperture, and having a tongue located in the aperture and having a slot configured to mate with the tab; and c) directing the clip assembly into the aperture so that the tongue mates with the recess and the tab mates with the slot, thereby to attach the clip assembly to the panel.

2. A method as defined in claim 1 further comprising providing a ridge inside the aperture and side grooves on the clip assembly and directing the ridge into the side grooves simultaneously.

3. A method for use with a handheld device for detaching a clip assembly from a panel having an aperture, comprising:

a) providing a clip assembly having a recess and a panel having an aperture with a tongue located in the aperture, the tongue having a slot and the recess having a tab, the clip assembly being mated to the aperture, the tongue being mated with the recess and the tab being mated with the slot, thereby to secure the clip assembly to the panel;

b) directing the tongue away from the recess, thereby to disengage the slot from the tab; and c) directing the clip assembly out of the aperture, thereby to detach the clip assembly from the panel.

4. A method for use with a handheld device for attaching a replacement insert to a panel having an aperture, comprising:

a) providing a replacement insert having a recess and a panel having an aperture with a tongue located in the aperture, the tongue having a slot and the recess having a tab; and b) directing the replacement insert into the aperture so that the tongue mates with the recess and the tab mates with the slot, thereby attaching the replacement insert to the panel.

5. A method as defined in claim 4 further comprising providing a ridge inside the aperture and side grooves on the replacement insert and directing the ridge into the side grooves simultaneously.

6. A method for use with a handheld device for detaching a replacement insert from a panel having an aperture, comprising:

a) providing a replacement insert having a recess, and a panel having an aperture with a tongue located in the aperture, the tongue having a slot and the recess having a tab, the replacement insert being mated to the aperture, the tongue being mated with the recess and the tab being mated with the slot, thereby to secure the replacement insert to the panel;

b) directing the tongue away from the recess, thereby to disengage the slot from the tab; and c) directing the replacement insert out of the aperture, thereby to detach the replacement insert from the panel.

7. A support assembly for a handheld device comprising:

a clip assembly comprising a base portion having a recess defined therein, with a tab positioned in the recess; and a panel having an aperture with a tongue positioned in the aperture, the tongue having a slot for mating with the tab, wherein the clip assembly is coupled to the panel by positioning the tongue in the recess such that the tab mates with the slot.

8. The support assembly of claim 7, wherein the tongue is rectangular and the slot in the tongue is rectangular, and the tab extends outwardly from a surface of the recess and is rectangular.

9. The support assembly of claim 7, further comprising a clip coupled to the base portion of the clip assembly.

10. The support assembly of claim 7, wherein the clip is elongated and is coupled to the base portion by a spring.

11. The support assembly of claim 9, wherein the clip is coupled to the rear side of the base portion opposite the recess side.

12. The support assembly of claim 9, wherein the base portion includes two protrusions on the rear side of the base portion, said protrusions including openings, and said clip includes two posts for mating with the openings in the protrusions to attach the clip to the base portion.

13. The support assembly of claim 7, wherein the panel comprises a narrowed portion around the periphery of the aperture and the clip assembly base portion includes a groove position around at least a portion of the outer periphery thereof, said groove configured to mate with the narrowed portion of the panel to seat the clip assembly base portion on the panel.

14. The support assembly of claim 7, further comprising a pair of crimps, each of which is mounted to one side of the panel around the edge of the aperture, said crimps having a shape that substantially conforms to the shape of the aperture.

15. The support assembly of claim 14, wherein the crimps are mounted to the panel over the base portion of the clip assembly.

* * * * *

UNITED STATES PATENT AND TRADEMARK OFFICE

CERTIFICATE OF CORRECTION

PATENT NO. : 6,405,910 B1 
DATED : June 18, 2002
INVENTOR(S) : James C. Infanti and Jason Griffin It is certified that error appears in the above-identified patent and that said Letters Patent is hereby corrected as shown below:

Column 7,
Line 10, change "claim 7" to -- claim 9 --

Signed and Sealed this

Seventeenth Day of December, 2002

JAMES E. ROGAN
*Director of the United States Patent and Trademark Office*